US006243558B1

(12) United States Patent
Oota

(10) Patent No.: US 6,243,558 B1
(45) Date of Patent: Jun. 5, 2001

(54) FIXING DEVICE, IMAGE FORMING APPARATUS WITH THE FIXING DEVICE, AND METHOD OF FIXING DEVELOPING AGENT IMAGE

(75) Inventor: Hiroshi Oota, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/521,949

(22) Filed: Mar. 9, 2000

(51) Int. Cl.[7] ..... G03G 15/20
(52) U.S. Cl. ..... 399/326; 15/256.51; 399/327
(58) Field of Search ..... 399/71, 326, 320, 399/324, 325, 327; 15/256.51

(56) References Cited

U.S. PATENT DOCUMENTS 5,978,640 * 11/1999 Segawa ..... 399/327
6,014,538 * 1/2000 Imamiya et al. ..... 399/327

FOREIGN PATENT DOCUMENTS 8-227246 9/1996 (JP) .

* cited by examiner

*Primary Examiner*—William Royer
*Assistant Examiner*—Hoan Tran
(74) *Attorney, Agent, or Firm*—Foley & Lardner

(57) ABSTRACT

A fixing device for a copying machine includes a heating roller having a heating portion therein, a press roller provided in rolling contact with the heating roller, and a cleaning mechanism for cleaning the heating roller and the press roller. The cleaning mechanism has a cleaning roller provided in rolling contact with the heating roller, and a pressure changing mechanism for changing a pressure applied by the cleaning roller to the heating roller. The pressure changing mechanism continuously changes the pressure of the cleaning roller within a predetermined pressure range at a period shorter than a passing time of the recording sheet passing through a portion between the heating roller and the press roller.

18 Claims, 6 Drawing Sheets

| | PRESSURE CONDITION FOR CLEANING ROLLER | CLEANING PERFORMANCE OF FELT ROLLER | SERVICE LIFE PERFORMANCE OF FELT ROLLER |
|---|---|---|---|
| | | | NUMBER (COUNT) UNTIL CONTAMINATION ATTACHING TO FELT ROLLER IS TRANSFERRED TO HEATING ROLLER OFTEN TO CAUSE PROBLEM |
| 1 | FIXED AT 200g | × | 200k (DUE TO INSUFFICIENT CLEANING) |
| 2 | FIXED AT 400g | △ | 400k (DUE TO INSUFFICIENT CLEANING) |
| 3 | FIXED AT 500g | ○ | 480k |
| 4 | FIXED AT 600g | ○ | 450k |
| 5 | FIXED AT 800g | ○ | 400k |
| 6 | FIXED AT 1000g | ○ | 300k |
| 7 | FIXED AT 1200g | ○ | 200k |
| 8 | 400 TO 600g | ○ | 550k |
| | | CLEANING PERFORMANCE CONTAMINATION ATTACHING STATE CAUSED BY INSUFFICIENT CLEANING OF HEATING ROLLER<br>○: ATTACHMENT DOES NOT OCCUR BEFORE SERVICE LIFE EXPIRES<br>△: SMALL AMOUNT OF ATTACHMENT OCCURS BEFORE SERVICE LIFE EXPIRES AS WELL<br>×: LARGE AMOUNT OF ATTACHMENT OCCURS FROM THE INITIAL STAGE | |

FIG. 8

FIXING DEVICE, IMAGE FORMING APPARATUS WITH THE FIXING DEVICE, AND METHOD OF FIXING DEVELOPING AGENT IMAGE

BACKGROUND OF THE INVENTION

The present invention relates a fixing device for fixing a developer image formed on a transfer medium, an image forming apparatus with the fixing device, and a method of fixing the developer image.

An image forming apparatus such as a copying machine or a printer has a fixing device for heating and fusing a developer image formed on a transfer sheet, thereby fixing the developer image on the transfer sheet. This fixing device generally has a heating roller incorporating a heating source such as a heater, and a press roller in rolling contact with the heating roller with a predetermined pressure. The transfer sheet formed with the developer image is conveyed through a portion between the heating roller and press roller. During conveyance, the developer image is fixed to the transfer sheet by the heat and pressure respectively applied by the heating roller and press roller.

The fixing device has a cleaning roller for removing contamination attaching to the heating roller and press roller. The cleaning roller is in rolling contact with the outer surface of at least the heating roller and is urged against the heating roller with a predetermined pressure. As the cleaning roller, a felt roller is mainly used. Felt rollers are roughly classified into those impregnated with silicone oil to supply it, and those not using silicone oil. Felt rollers of either type perform cleaning by wiping out contamination on the heating roller.

When the pressure acting on the cleaning roller is large, although the cleaning performance of the cleaning roller increases, the cleaning roller becomes dirty at an early stage to shorten its service life. To the contrary, when the pressure acting on the cleaning roller is small, although the service life prolongs, the cleaning performance of the cleaning roller degrades. Then, contamination on the heating roller and the press roller cannot be removed sufficiently, and undesirably attaches to a transfer sheet.

When the heating roller and the press roller are cleaned, contamination such as the removed toner, paper dust, and the like attach to the felt roller. If a large amount of contamination attaches to the felt roller over a long-term use, for example, at the start of the fixing operation of the fixing device, contamination attaching to the felt roller is sometimes transferred from the felt roller to the heating roller and the press roller. In this case, contamination attaches to the transfer sheet to cause an image defect. Contamination transfer as described above tends to occur particularly when the pressure acting on the cleaning roller is large.

BRIEF SUMMARY OF THE INVENTION

The present invention has been made in view of the above situation, and has as its object to provide a fixing device, an image forming apparatus, and a method of fixing a developer image, which can improve the cleaning performance without shortening the service life of the cleaning roller, and can reduce the amount of contamination transfer from the cleaning roller.

In order to achieve the above object, according to the present invention, there is provided a fixing device comprising: fixing means having a pair of rollers which are in rolling contact with each other, for fixing a developer image formed on a recording sheet passing between the pair of rollers; a cleaning mechanism having a cleaning roller provided in rolling contact with at least one of the pair of rollers, for cleaning contamination on an outer surface of the one roller; and a pressure changing mechanism for changing a pressure applied by the cleaning roller to the one roller at a predetermined period in a fixing operation with respect to one recording sheet.

An image forming apparatus according to the present invention comprises: an image forming section for forming a developer image on a recording sheet; a fixing device for heating and pressing the recording sheet where the developer image has been formed by the image forming section, thereby fixing the developer image on the recording sheet; a paper supply section for selectively supplying various types of recording sheets having different sizes; and a convey mechanism for conveying the recording sheet fed from the paper feed section through the image forming section and the fixing device;

the fixing device including: fixing means having a pair of rollers which are in rolling contact with each other, for fixing a developer image formed on a recording sheet passing between the pair of rollers; a cleaning mechanism having a cleaning roller provided in rolling contact with at least one of the pair of rollers, for cleaning contamination on an outer surface of the one roller; and a pressure changing mechanism for changing a pressure applied by the cleaning roller to the one roller at a predetermined period in a fixing operation with respect to one recording sheet.

Further, according to the present invention, the predetermined period is shorter than a passing time of the recording sheet passing through the pair of rollers. The pair of rollers includes a heating roller having a heating portion therein, and a press roller provided in rolling contact with the heating roller and cooperating with the heating roller to heat and press the recording sheet passing between the heating roller and press rollers.

According to the fixing device and the image forming apparatus, the pressure changing mechanism has a cam arranged in contact with a rotating shaft of the cleaning roller, and a driving source for rotating the cam.

With the fixing device and the image forming apparatus having the above-mentioned arrangement, the pressure applied by the cleaning roller to the roller of the cleaning means is changed by the pressure changing mechanism within a predetermined period, when fixing is performed on one recording sheet. If the change range of the pressure is appropriately set, improvement in both the cleaning performance and the service life of the cleaning roller can be achieved more than in a case wherein the pressure is fixed. Simultaneously, the amount of contamination transfer from the cleaning roller to the heating roller, occurring at the operation start of the fixing device, decreases.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

FIGS. 1 to 7 show a digital copying machine according to an embodiment of the present invention, in which:

FIG. 1 is a sectional view of the digital copying machine;

FIG. 2 is a block diagram showing the control system of the digital copying machine;

FIG. 3 is a sectional view showing the fixing device of the digital copying machine;

FIG. 4 is a front view showing the heating roller and press roller of the fixing device;

FIG. 5 is a block diagram schematically showing the arrangement of the fixing device;

FIG. 6 is a sectional view showing a pressure changing mechanism for the fixing device;

FIG. 7 is a graph showing the change range and the change period of a pressure in the pressure changing mechanism; and FIG. 8 is a graph showing in comparison the cleaning performance and service life of a cleaning roller for the fixing device in a case wherein the pressure of the cleaning roller is fixed and a case wherein the pressure is changed on the basis of the embodiment described above.

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment in which an image forming apparatus according to the present invention is applied to a digital copying machine will be described in detail with reference to the accompanying drawings.

This digital copying machine is a multi-functional copying machine for forming a copy image in accordance with image data read from an original and image data input from an external device such as a personal computer.

Figure 1:
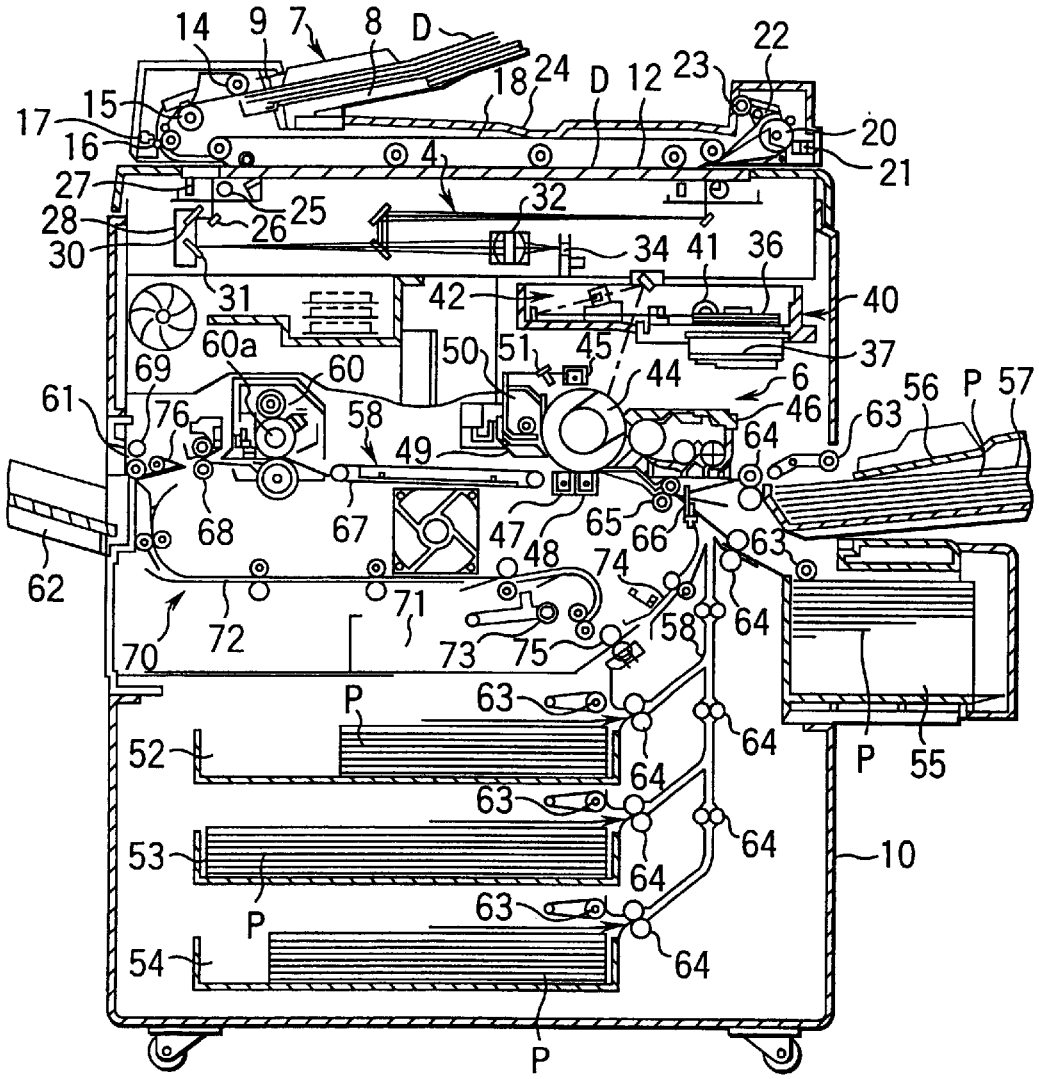

As shown in FIG. 1, the digital copying machine has a rectangular box-shaped housing 10. A scanner unit 4 which serves as an image reader, and a printer unit 6 for forming an image on a copy sheet are provided in the housing 10.

On the upper surface of the housing 10 is provided an original table 12 made of transparent glass, on which an original D having a reading target, i.e., a processing target image, is to be set. An automatic document feeder 7 (to be referred to as the ADF hereinafter) for automatically feeding the original onto the original table 12 is disposed on the upper surface of the housing 10. The ADF 7 can open/close the original table 12, and also serves as an original holder for causing the original D set on the original table into tight contact with the original table 12.

The ADF 7 has an original tray 8, empty sensor 9, pickup roller 14, paper feed roller 15, aligning roller pair 16, size sensor 17, and conveyor belt 18. The original D is set on the original tray 8. The empty sensor 9 detects the presence/absence of an original. The pickup roller 14 picks up originals from the original tray 8 one by one. The paper feed roller 15 conveys the picked original. The aligning roller pair 16 aligns the leading end of the original. The size sensor 17 detects the size of the original D. The conveyor belt 18 is disposed to cover the original table 12 almost entirely. The plurality of originals set on the original tray 8 to face upward are sequentially picked up starting from the one located at the top, and each original is aligned by the aligning roller pair 16, and is conveyed by the conveyor belt 18 to a predetermined position on the original table 12.

In the ADF 7, an inverting roller 20, non-inversion sensor 21, flapper 22, and delivery roller 23 are disposed at an end on a side opposite to the aligning roller pair 16 through the conveyor belt 18. The original D, from which image data has been read by the scanner unit 4 (to be described later), is fed out by the conveyor belt 18 from the original table 12, and is delivered onto an original delivery unit 24 on the upper surface of the ADF 7 through the inverting roller 20, flapper 21, and delivery roller 22. When the lower surface of the original D is to be read, the flapper 22 is switched. Then, the original D conveyed by the conveyor belt 18 is inverted by the inverting roller 20, and is sent by the conveyor belt 18 to the predetermined position on the original table 12 again.

The scanner unit 4 disposed in the housing 10 has an exposure lamp 25 and first mirror 26. The exposure lamp 25 serves as a light source for illuminating the original D set on the original table 12. The first mirror 26 deflects light reflected by the original D in a predetermined direction. The exposure lamp 25 and first mirror 26 are mounted on a first carriage 27 disposed below the original table 12. The first carriage 27 is movable parallel to the original table 12, and is reciprocally moved below the original table 12 by a drive motor through a toothed belt (not shown).

A second carriage 28 movable parallel to the original table 12 is disposed below the original table 12. Second and third mirrors 30 and 31 for deflecting the light reflected by the original D and deflected by the first mirror 26 are mounted on the second carriage 28 to be perpendicular to each other. The second carriage 28 is driven by a toothed belt or the like, which drives the first carriage 27, with respect to the first carriage 27, and is moved parallel to the first carriage along the original table 12 at a speed ½ that of the first carriage.

An image forming lens 32 and a CCD sensor 34 are disposed below the original table 12. The image forming lens 32 focuses light reflected by the third mirror 31 on the second carriage 28. The CCD sensor 34 receives the reflected light focused by the image forming lens and photoelectrically converts it. The image forming lens 32 is disposed within a plane including the optical axis for light deflected by the third mirror 31, to be movable through a driving mechanism. When the image forming lens 32 moves, it forms an image of the reflected light with a desired magnification. The CCD sensor 34 photoelectrically converts incident reflected light and outputs an electrical signal corresponding to the read original D. More specifically, the CCD sensor 34 converts the light, emitted by the light source to irradiate the original and reflected by the original, into an electrical signal in units of unit pixels obtained by dividing the document image as the original horizontally and vertically, and outputs 8-bit digital data in units of pixels.

The printer unit 6 has a laser exposure unit 40 which operates as a latent image forming means. The laser exposure unit 40 has a semiconductor laser 41, polygon mirror 36, polygon motor 37, and optical system 42. The semiconductor laser 41 serves as the light source. The polygon mirror 36 serves as a scanning member for continuously deflecting a laser beam emitted from the semiconductor laser 41. The polygon motor 37 serves as a scanning motor for rotationally driving the polygon mirror 36 at a predetermined frequency (to be described later). The optical system 42 deflects the laser beam from the polygon mirror and guides it to a photoconductive drum 44 (to be described later). The laser exposure unit 40 having this arrangement is fixed to and supported by a support frame (not shown) of the housing 10.

The semiconductor laser 41 is ON/OFF-controlled in accordance with the image data of the original D read by the scanner unit 4, image data input from an external device 130, document information exchanged between facsimile machines, or the like. The laser beam from the semiconductor laser 41 is directed toward the photoconductive drum 44 through the polygon mirror 36 and optical system 42, and scans the outer surface of the photoconductive drum 44, to form an electrostatic latent image on the outer surface of the photoconductive drum 44.

The printer unit 6 has the rotatable photoconductive drum 44 serving as an image carrier disposed at almost the center of the housing 10. The cicumferential surface of the photoconductive drum 44 is exposed by the laser beam from the laser exposure unit 40, to form a desired electrostatic latent image. An electrostatic charger 45, developing unit 46, transfer charger 48, separation pawl 49, cleaning unit 50, and discharger 51 are sequentially arranged around the photoconductive drum 44. The electrostatic charger 45 electrostatically charges the outer surface of the drum with predetermined charges. The developing unit 46 supplies toner as a developing agent to the electrostatic latent image formed on the outer surface of the photoconductive drum 44, to develop the latent image with a desired image density. The transfer charger 48 integrally has a separation charger 47 for separating a recording sheet supplied from a paper cassette (to be described later), i.e., a copy sheet P, from the photoconductive drum 44, and transfers a toner image formed on the photoconductive drum 44 onto the copy sheet P. The separation pawl 49 separates the copy sheet P from the outer surface of the photoconductive drum 44. The cleaning unit 50 cleans the toner left on the outer surface of the photoconductive drum 44. The discharger 51 electrostatically discharges the outer surface of the photoconductive drum 44. The laser exposure unit, the photoconductive drum, the electrostatic charger, the developing unit, the separation charger, the transfer charger, the cleaning unit, and the discharger make up the image forming section of the present invention.

Upper, middle, and lower cassettes 52, 53, and 54 that can be drawn from the housing are stacked on each other in the lower portion of the housing 10, and copy sheets having different sizes are loaded in the respective cassettes. For example, A4-R size copy sheets are loaded in the upper cassette 52 as the first recording sheets, B4 size copy sheets are loaded in the middle cassette 53 as the second recording sheets, and A3 size copy sheets are loaded in the lower cassette 54 as the third recording sheets. A large-capacity feeder 55 is provided on a side of these cassettes and stores about 3000 copy sheets P with a size which is used frequently, e.g., A4 size copy sheets P. A paper feed cassette 57 serving also as a manual feed tray 56 is detachably mounted above the large-capacity feeder 55.

A convey path 58 is formed in the housing 10 to extend from the respective cassettes and the large-capacity feeder 55 through a transfer portion located between the photoconductive drum 44 and transfer charger 48. A fixing device 60 is formed at the terminal end of the convey path 58. A delivery port 61 is formed in the side wall of the housing 10 opposing the fixing device 60, and a delivery tray 62 is attached to the delivery port.

Pickup rollers 63 are respectively provided in the vicinities of the upper cassette 52, middle cassette 53, lower cassette 54, and paper feed cassette 57, and in the vicinity of the large-capacity feeder 55, to pickup the copy sheets P from the cassettes or large-capacity feeder one by one. The convey path 58 is provided with a large number of paper feed roller pairs 64 which convey the copy sheet P picked up by the corresponding pickup roller 63 through the convey path 58. The cassettes 53, 54, and 57, large-capacity feeder 55, pickup rollers 63, and paper feed roller pairs 64 form a paper feed unit.

In the convey path 58, a resist roller pair 65 is provided upstream of the photoconductive drum 44. The resist roller pair 65 corrects ramp of the picked copy sheet P, aligns the leading end of the toner image on the photoconductive drum 44 with the leading end of the copy sheet P, and feeds the copy sheet P to the transfer unit at the same speed as the moving speed of the outer surface of the photoconductive drum 44. A prealigning sensor 66 is provided before the resist roller pair 65, i.e., on the side of the paper feed roller pairs 64, to detect arrival of the copy sheet P and size of the copy sheet.

The copy sheets P picked up from the respective cassettes or the large-capacity feeder 55 one by one by the pickup rollers 63 are fed to the resist roller pair 65 by the paper feed roller pairs 64. The copy sheet P is fed to the transfer unit after its leading end is aligned by the resist roller pair 65.

In the transfer unit, the developer image formed on the photoconductive drum 44, i.e., the toner image, is transferred onto the copy sheet P with the transfer charger 48. The copy sheet P transferred with the toner image is separated from the outer surface of the photoconductive drum 44 by the operations of the separation charger 47 and separation pawl 49, and is conveyed to the fixing device 60 through a conveyor belt 67 constituting part of the upper cassette 52. After the developer image is fused and fixed to the copy sheet P by the fixing device 60, the copy sheet P is delivered onto the delivery tray 62 by a paper feed roller pair 68 and delivery roller pair 69 through the delivery port 61.

An automatic two-sided transfer unit 70 is provided below the convey path 58 to invert the copy sheet P, passing through the fixing device 60, to the resist roller pair 65 again. The automatic two-sided transfer unit 70 has a temporary stacking portion 71, inverting path 72, pickup roller 73, and paper feed roller 75. The temporary stacking portion 71 temporarily stores the copy sheets P. The inverting path 72 branches from the convey path 58, inverts the copy sheet P passing through the fixing device 60, and guides it to the temporary stacking portion 71. The pickup roller 73 picks up the copy sheets P stacked at the temporary stacking portion 71 one by one. The paper feed roller 75 feeds the picked sheet to the resist roller pair 65 through a convey path 74. A selector gate 76 is formed at the branching portion of the convey path 58 and inverting path 72 to selectively sort the copy sheets P to the delivery port 61 and inverting path 72.

When two-sided copying operation is to be performed, the copy sheet P passing through the fixing device 60 is guided to the inverting path 72 by the selector gate 76, is inverted, and is temporarily stacked on the temporary stacking portion 71. The copy sheet P is then sent to the resist roller pair 65 by the pickup roller 73 and paper feed roller pair 75 through the convey path 74. The copy sheet P is aligned by the resist roller pair 65, and is sent to the transfer unit again. Then, the toner image is transferred to the lower surface of the copy sheet P. After that, the copy sheet P is delivered onto the delivery tray 62 through the convey path 58, fixing device 60, and delivery roller 69.

Figure 2:
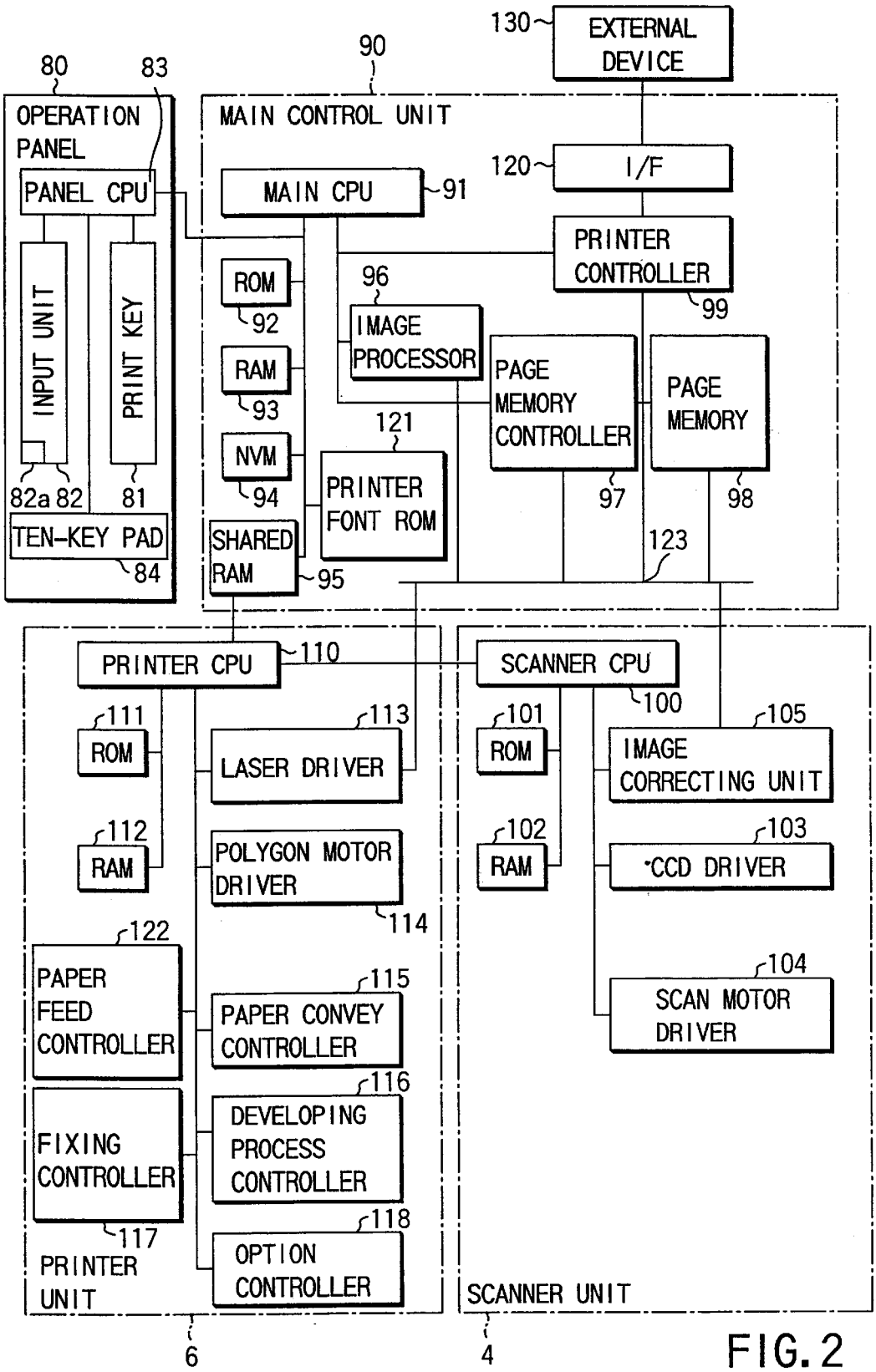

The digital copying machine also includes an operation panel 80 and main control unit 90, as shown in FIG. 2.

The operation panel 80 includes a print key 81, input unit 82, panel CPU 83, and ten-key pad 84. The print key 81 instructs copy start. The input unit 82 has a plurality of pushbutton switches or a transparent touch sensor panel which is formed on the screen of a color display tube or on a liquid crystal panel, to input conditions for image output in the digital copying machine, e.g., the copy or print count, the magnification, and the sheet size, or to designate partial copy and to input the coordinates of the designated region. The panel CPU 83 controls the operation panel 80. The ten-key pad 84 is used to set the copy count and the copy magnification. Furthermore, the input unit 82 of the operation panel 80 has a facsimile key 82*a* needed when the copying machine is used as a facsimile.

The input unit 82 is formed in accordance with the operation procedure of the digital copying machine or the conditions to be input, and has a touch sensor serving as a plurality of input keys, and a display portion. Icons, numerals, characters, or character strings are displayed on the touch sensor. Operation guide, input content, and the like are displayed on the display portion. This display portion displays the copy count, the copy magnification, sheet size, copy OK, the memory capacity for sorting, the readable original count corresponding to the memory capacity.

As shown in FIG. 2, the control system of a color copying machine is comprised of three CPUs, i.e., a main CPU (Central Processing Unit) 91 in the main control unit 90, a scanner CPU 100 in the scanner unit 4, and a printer CPU 110 in the printer unit 6. The main CPU 91 performs two-way communications with the printer CPU 110 through a shared RAM 95. The main CPU 91 outputs an operation instruction, and the printer CPU 110 returns a status signal. The printer CPU 110 and scanner CPU 100 perform serial communication. The printer CPU 110 outputs an operation instruction, and the scanner CPU 100 returns a status signal. The operation panel 80 is connected to the main CPU 91.

The main control unit 90 is comprised of the main CPU 91, a ROM 92, a RAM 93, an NVM 94, the shared RAM 95, an image processor 96, a page memory controller 97, a page memory 98, a printer controller 99, and a printer font ROM 151. The printer controller 99 is connected to the external device 130 such as a personal computer through an interface 120.

The main CPU 91 controls the main control unit 90 entirely. The ROM 92 stores a control program. The RAM 93 temporarily stores data.

The NVM (nonvolatile RAM) 94 is a nonvolatile memory backed up by a battery (not shown). When the power supply is turned off, data on the NVM 94 is held. The shared RAM 95 is used to perform two-way communications between the main CPU 91 and printer CPU 110.

The main CPU 91 stores image data of an original read by the scanner unit 4, image data input from the external device 130, the original size, the sheet size, the reduction (enlargement) ratio, and the like in the page memory 98. The main CPU 91 also determines the sheet size in accordance with the original size detected by the size sensor 17 of the scanner unit 4, and stores the determination result in the page memory 98.

The page memory controller 97 stores/reads out image data in/from the page memory 98. The printer font ROM 121 stores font data corresponding to the print data.

The printer controller 99 bitmaps image data sent from the external device 130 into image data by using font data stored in the printer font ROM 121 with a resolution corresponding to data indicating the resolution added to the image data.

The scanner unit 4 is comprised of the scanner CPU 100, and a ROM 101, RAM 102, CCD driver 103, scan motor driver 104, and image correcting unit 105. The scanner CPU 100 controls the scanner unit 4 entirely. The ROM 101 stores a control program and the like. The RAM 102 stores data. The CCD driver 103 drives the CCD sensor 34. The scan motor driver 104 controls rotations of motors which move the exposure lamp 25, the mirrors 26, 27, and 28, and the like. The image correcting unit 105 is comprised of an A/D converter, shading correction circuit, and line memory. The A/D converter converts an analog signal from the CCD sensor 34 into a digital signal. The shading correction circuit corrects changes in the threshold level, which correspond to an output signal from the CCD sensor 34 and are caused by changes in the CCD sensor 34 or by an atmospheric temperature change. The line memory temporarily stores the shading-corrected digital signal from the shading correction circuit.

The printer unit 6 is comprised of the printer CPU 110, and a ROM 111, RAM 112, laser driver 113, polygon motor driver 114, paper feed controller 123, paper convey controller 115, developing process controller 116, fixing controller 117, and option controller 118. The printer CPU 110 controls the printer unit 6 entirely. The ROM 111 stores a control program and the like. The RAM 112 stores data. The laser driver 113 turns on/off the semiconductor laser 41. The polygon motor driver 114 controls rotation of the polygon motor 37 of the laser unit 40. The paper feed controller 123 controls the operation of the paper feed unit which feeds the copy sheet P. The paper convey controller 115 controls the operation of a convey mechanism which conveys the copy sheet P. The developing process unit 116 performs charging, development, and transfer by using the electrostatic charger 45, developing unit 46, and transfer charger 48. The fixing controller 117 controls the fixing device 60.

The image processor 96, page memory controller 97, page memory 98, printer controller 99, image correcting unit 105, and laser driver 113 are connected to each other via an image data bus 123.

The arrangement of the fixing device 60 will be described in detail.

Figure 3:
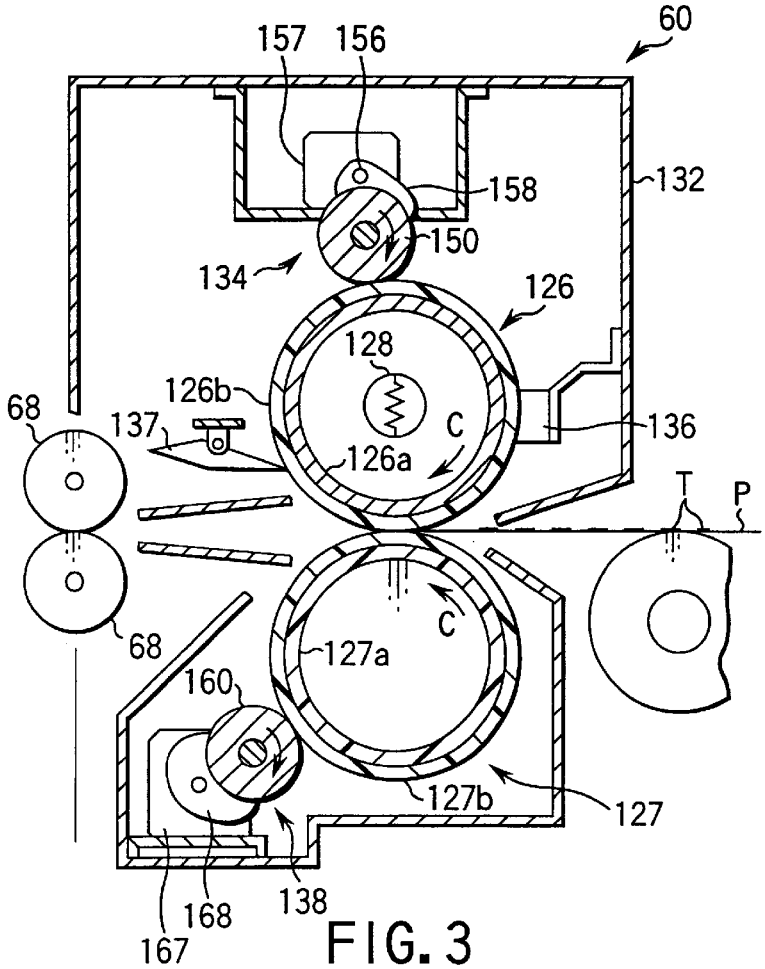
Figure 4:
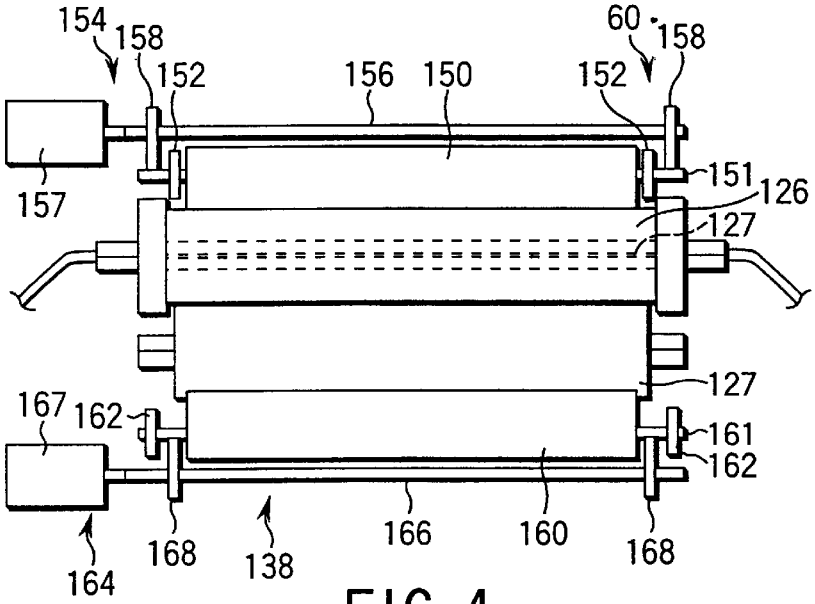

As shown in FIGS. 1, 3, and 4, the fixing device 60 has a heating roller 126 and a press roller 127 which is in rolling contact with the heating roller with a predetermined pressure. These rollers extend parallel to each other.

As the heating roller 126, for example, one obtained by covering the outer surface of a 60-mm diameter, 8-mm thick cylindrical core bar 126*a* made of aluminum and having an inverted crown amount of 180 $\mu$m with a 25-$\mu$m thick fluoroplastic coating layer 126*b* is used. A heater lamp 128 serving as the heating portion is disposed in the heating roller 126, and the heating roller 126 is heated by this heater lamp. As the heater lamp 128, for example, a halogen lamp having an output of 900 W is used. The two ends in the axial direction of the heating roller 126 are rotatably supported by bearings respectively.

The press roller 127 is formed by covering a 60-mm diameter, 5.0-mm thick rubber tube 127*a* having a rubber hardness of 45° (ASKER-C) with a 90-$\mu$m thick surface layer 127*b* made of a fluoroplastic tube. The axial length of the heating roller 126 is 320 mm at the portion corresponding to the fluoroplastic coating layer 126*b*, and the axial length of the press roller 127 is 316 mm at the portion corresponding to the surface layer 127*b*. A fixing load of about 900 N is applied to the heating roller 126 and press roller 127 with a press spring (not shown). These heating roller 126 and press roller 127 are covered with covers 132 except for a press-contact portion between them.

Figure 5:
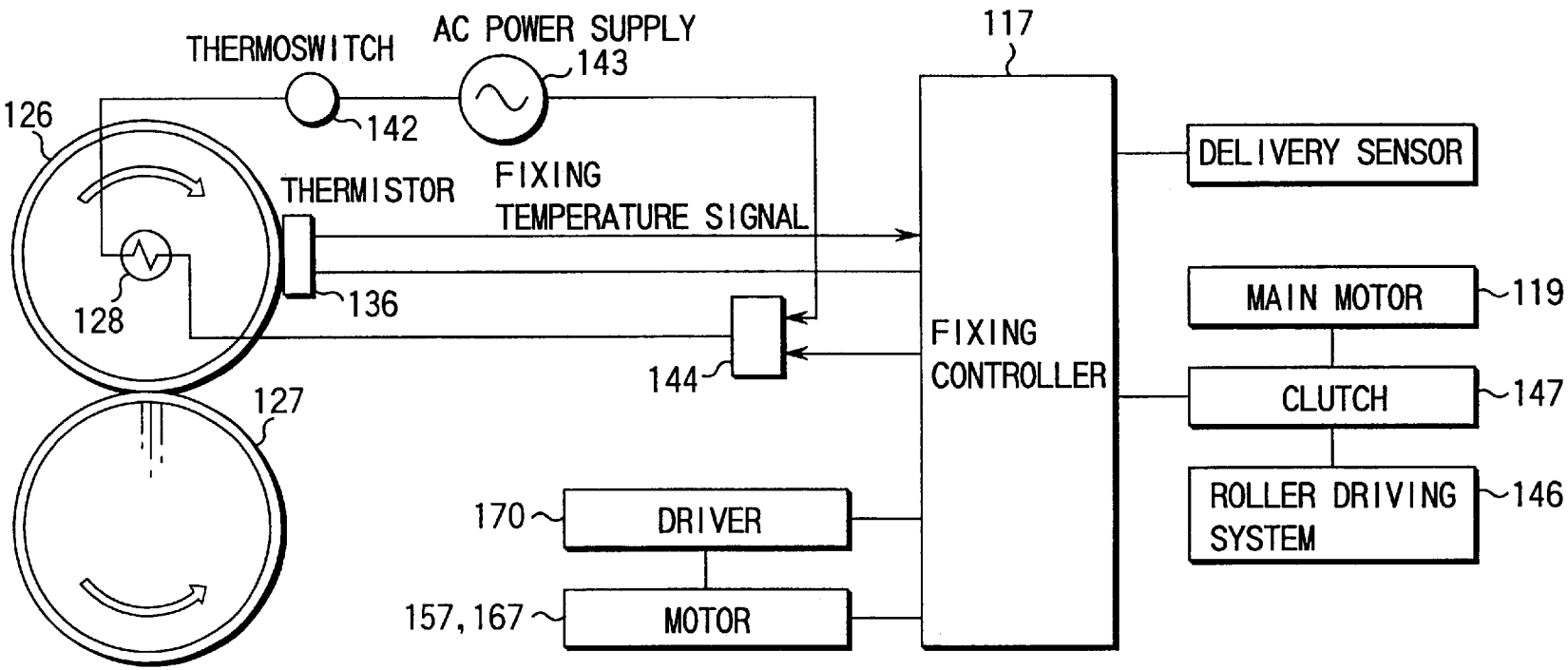
Figure 6:
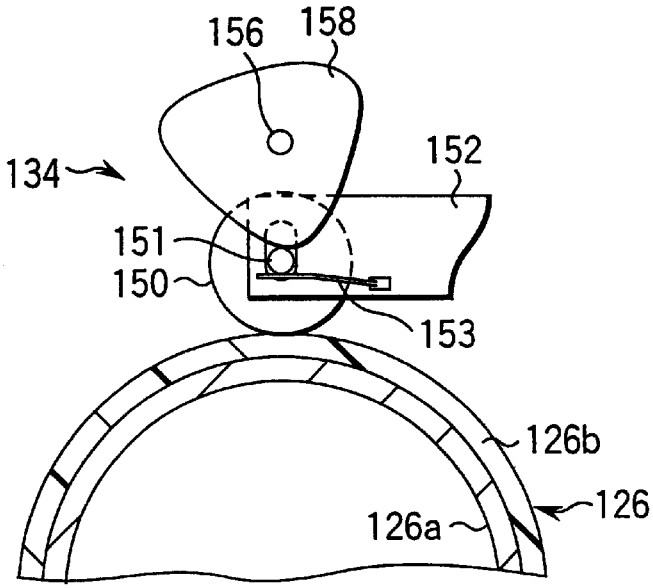

As shown in FIG. 5, the heater lamp 128 of the heating roller 126 is connected to an AC power supply 143 through a thermoswitch 142, and to the fixing controller 117 described above through a thyristor 144.

A thermistor 136 inputs a detected temperature signal to the fixing controller 117. The fixing controller 177 turns on/off the heater lamp 128 in accordance with the detection temperature of the thermistor 136, thereby maintaining the surface temperature of the heating roller 126 to, e.g., 200° C.

A roller driving system 146 serving as a driving unit for rotationally driving the heating roller 126 and press roller 127 is connected to a main motor 119 of the printer unit 6 through an electromagnetic clutch 147. The fixing controller 117 turns on/off the electromagnetic clutch 147, thereby controlling rotation of the heating roller 126 and press roller 127.

As shown in FIGS. 3 to 6, a first cleaning mechanism 134, the thermistor 136, and a separation pawl 137 are arranged around the heating roller 126. The first cleaning mechanism 134 cleans contamination such as the toner or paper dust attaching to the outer surface of the heating roller. The thermistor 136 detects the surface temperature of the heating roller. The separation pawl 137 separates the copy sheet P from the outer surface of the heating roller. The thermistor 136 is provided at the central portion of the heating roller 126 in the longitudinal direction, to be in contact with the outer surface of the heating roller. A second cleaning mechanism 138 is also arranged around the press roller 127 to clean contamination such as the toner or paper dust attaching to the outer surface of the press roller.

The first cleaning mechanism 134 has a first cleaning roller 150. The first cleaning roller extends parallel to the heating roller throughout almost the entire length of the heating roller 126, to be in rolling contact with its outer surface. The first cleaning roller 150 is rotated by the heating roller 126. For example, the first cleaning roller 150 is formed of 2-mm thick heat-resistant felt to have a diameter of 28 mm, and is impregnated with silicone oil. A rotating shaft 151 of the first cleaning roller 150 is supported by a pair of support frames 152 to be movable in a direction to come close to/separate from the heating roller 126.

Furthermore, the first cleaning mechanism 134 has a pressure changing mechanism 154 for continuously changing the pressure applied by the first cleaning roller 150 to the heating roller 126 with a predetermined period. The pressure changing mechanism 154 has a driving shaft 156, a pair of cams 158, and motor 157. The driving shaft 156 is set on a side opposite to the heating roller 126 through the first cleaning roller 150 and extends parallel to the first cleaning roller. The pair of cams 158 are fixed to this driving shaft and respectively abut against the two ends of the rotating shaft 151 of the first cleaning roller. The motor 157 rotationally drives the driving shaft 156. Plate springs 153 are attached to the respective support frames 152 to bias the rotating shaft 151 of the first cleaning roller 150 toward the cams 158.

Figure 7:
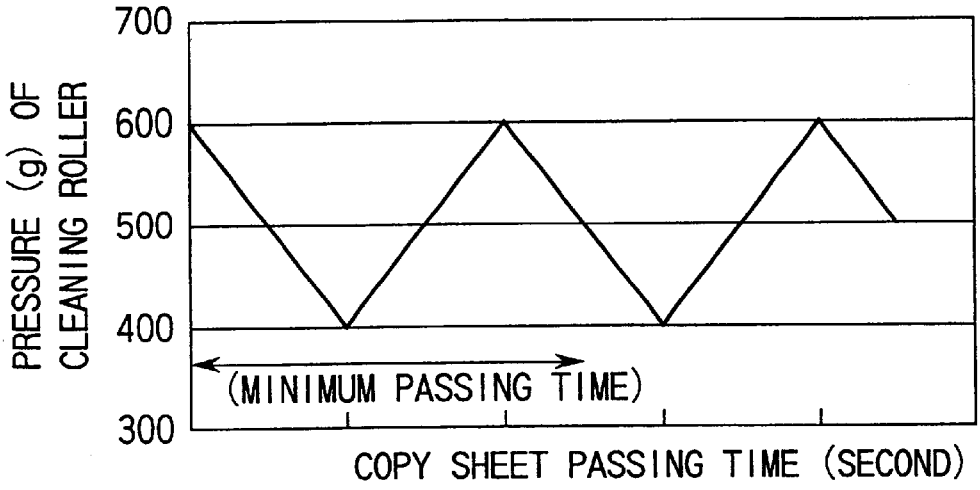

In the fixing operation of the fixing device 60, the pressure changing mechanism 154 is driven by the motor 157 to rotate, together with the driving shaft 156, the pair of cams 158 at a predetermined speed. Accordingly, the cams 158 displace the first cleaning roller 150 through the rotating shaft 151 in a direction to come close to/separate from the heating roller 126. As a result, as shown in FIG. 7, the pressure applied by the first cleaning roller 150 to the heating roller 126 changes continuously with a predetermined period. The change range of the pressure is set to, e.g., 400 g to 600 g, and the change period is set in accordance with the passing time of the copy sheet passing between the heating roller 126 and press roller 127 of the fixing device 60 in the image forming operation of the digital copying machine. More specifically, the passing time of the copy sheet is the shortest with the copy sheet having the minimum width among copy sheets P used in the digital copying machine. The change period of the pressure of the first cleaning roller 150 which is changed by the pressure changing mechanism 154 is set shorter than the minimum passing time of the copy sheet.

The second cleaning mechanism 138 has a second cleaning roller 160. The second cleaning roller extends parallel to the press roller throughout almost the entire length of the press roller 127, to be in rolling contact with its outer surface. The second cleaning roller 160 is rotated by the press roller 127. For example, the second cleaning roller 160 is formed of a 28-mm diameter metal roller. A rotating shaft 161 of the second cleaning roller 160 is supported by a pair of support frames 162 to be movable in a direction to come close to/separate from the press roller 127.

Furthermore, the second cleaning mechanism 138 has a pressure changing mechanism 164 for continuously changing the pressure applied by the second cleaning roller 160 to the press roller 127 with a predetermined period. The pressure changing mechanism 164 has the same arrangement as that of the pressure changing mechanism 154 of the first cleaning mechanism 134. More specifically, the pressure changing mechanism 164 has a driving shaft 166, a pair of cams 168, and motor 167. The driving shaft 166 is set on a side opposite to the press roller 127 through the second cleaning roller 160 and extends parallel to the second cleaning roller. The pair of cams 168 are fixed to this driving shaft and respectively abut against the two ends of the rotating shaft 161 of the second cleaning roller. The motor 167 rotationally drives the driving shaft 166.

In the fixing operation of the fixing device 60, the pressure changing mechanism 164 is driven by the motor 167 to rotate the pair of cams 168 at a predetermined speed, so that the second cleaning roller 160 is displaced through the rotating shaft 151 in a direction to come close to/separate from the press roller 127. As a result, the pressure applied by the second cleaning roller 160 to the press roller 127 changes continuously within the same change range and with the same change period as those of the first cleaning mechanism 134.

As shown in FIG. 5, the motors 157 and 167 of the first and second cleaning mechanisms 134 and 138 are connected to the fixing controller 117 through a driver 170 and is controlled by this fixing controller.

In the fixing device 60 having the above arrangement, when a copy sheet P on which a toner image T has been formed by the image forming section is fed to the fixing device 60 by a conveyor belt 67, this copy sheet P is guided to a portion between the heating roller 126 and press roller 127, and is conveyed by these rollers toward the paper delivery roller pair 68. When the copy sheet P passes through the portion between the heating roller 126 and press roller 127, the toner image T on the copy sheet P is heated and fused by the heating roller, and is urged against the copy sheet P by the pressure of the press roller. Thus, the toner image T is fused and fixed on the copy sheet P. The copy sheet P on which the toner image T is fixed is delivered onto the delivery tray 62 by the paper delivery roller pair 68.

During the fixing operation described above, the first cleaning roller 150 of the first cleaning mechanism 134 is driven by the heating roller 126 to roll on the outer surface of the heating roller, thereby cleaning it by wiping contamination attaching to it. Similarly, the second cleaning roller 160 of the second cleaning mechanism 138 is driven by the press roller 127 to roll on the outer surface of the press roller, thereby cleaning it by wiping contamination attaching to it. During cleaning, the pressure applied by the first cleaning roller 150 to the heating roller 126, and the pressure applied by the second cleaning roller 160 to the press roller 127 are continuously changed by the pressure changing mechanisms 154 and 164 within a predetermined change range at a predetermined change period.

When the pressures of the first and second cleaning rollers 150 and 160 are changed with a predetermined condition as described above, the service lives of the respective cleaning rollers, i.e., time periods until the cleaning rollers are soiled and unable to use, can be prolonged, while the necessary cleaning performance is maintained. Even when a large amount of contamination attaches to the cleaning rollers, the amount of contamination transferred from the cleaning roller to the heating roller or press roller, at the operation start of the fixing device 60, can be reduced.

The present inventors conducted a paper passing test in the digital copying machine described above by changing the pressure condition of the cleaning roller in various manners. FIG. 8 shows the result. As the cleaning roller, a felt roller was used. The cleaning performance and service life performance of the cleaning roller were tested in a case wherein the pressure applied by the cleaning roller to the heating roller was fixed at an arbitrary value within a range of 200 g to 1,200 g, and a case wherein this pressure was continuously changed within a range of 400 g to 600 g.

1) When the pressure was fixed at 200 g, the cleaning performance was insufficient. Contamination on the heating roller was not sufficiently removed but left on the roller surface. As the contamination on the heating roller increased, it attached to the copy sheet to cause an image defect such as image contamination. Therefore, an image defect occurred before the cleaning roller was completely soiled, and the cleaning roller could be used until only 200K sheets were copied. At the same time, a rotation defect sometimes occurred in the cleaning roller due to the pressure shortage.

2) When the pressure was fixed at 400 g, the cleaning performance was insufficient yet, and contamination remained on the surface of the heating roller. However, since the amount of remaining contamination reduced when compared to 1), it took long until a large amount of contamination was deposited on the heating roller. Therefore, the cleaning roller could be used until 400K sheets were copied.

3) When the pressure was fixed at 500 g, and 4) when the pressure was fixed at 600 g, the cleaning performance was sufficient in both cases, and contamination of the heating roller due to insufficient cleaning did not occur. Accordingly, no image defect occurred until a large amount of contamination was deposited on the cleaning roller, and the cleaning roller could be used until 480K sheets and 450K sheets were copied in the respective cases.

5), 6), 7) When the pressure was fixed at 800 g, 1,000 g, and 1,200 g, although the cleaning performance improved, the cleaning roller became dirty faster, and contamination transfer from the cleaning roller to the heating roller occurred early. As the pressure increased, the copy count until an image defect occurred decreased, e.g., when the pressure was 800 g, the copy count was 400K, when the pressure was 1,000 g, the copy count was 300K, and when the pressure was 1,200 g, the copy count was 200K.

8) As in the embodiment described above, when the pressure was changed continuously within a range of 400 g to 600 g at a period shorter than the minimum paper passing time, the time until the cleaning roller became dirty could be prolonged while maintaining the necessary cleaning performance. Simultaneously, even when a large amount of contamination attached to the cleaning roller, the amount of contamination transfer from the cleaning roller to the heating roller decreased. Therefore, the copy count until an image defect occurred increased to 550K, which is larger by 70K than the copy count 480K for 3) the pressure of 500 g, which is the best condition for a case wherein the pressure is fixed.

With the digital copying machine having the above arrangement, in the fixing device 60, the pressure applied by the first cleaning roller 150 to the heating roller 126, and the pressure applied by the second cleaning roller 160 to the press roller 127 are continuously changed within a predetermined change range at a predetermined change period. Therefore, improvement in both the cleaning performance and the service life of the cleaning roller can be achieved more than in a case wherein the pressure is fixed. Simultaneously, the amount of contamination transfer from the cleaning roller to the heating roller, occurring at the operation start of the fixing device, decreases. As a result, a fixing device, in which the cleaning performance is improved without shortening the service life of the cleaning roller and the amount of contamination transfer from the cleaning roller can be decreased, and a digital copying machine having this fixing device can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, an image forming apparatus according to the present invention is not limited to the digital copying machine described above, and the present invention can also be applied to other image forming apparatuses such as an analog copying machine, a laser printer, and the like. The material, diameter, pressure, and the like of the cleaning roller can be changed in various manners if necessary. The cleaning roller may be provided to only either one of the heating roller and the press roller.

What is claimed is:

1. A fixing device for fixing a developer image formed on a recording sheet onto the recording sheet, comprising:

fixing means having a pair of rollers which are in rolling contact with each other, for fixing a developer image formed on a recording sheet passing between the pair of rollers;

a cleaning mechanism having a cleaning roller provided in rolling contact with at least one of the pair of rollers, for cleaning contamination on an outer surface of said one roller; and a pressure changing mechanism for changing a pressure applied by the cleaning roller to said one roller at a predetermined period in a fixing operation with respect to one recording sheet.

2. A fixing device according to claim 1, wherein the predetermined period is shorter than a passing time of the recording sheet passing through the pair of rollers.

3. A fixing device according to claim 2, wherein the pair of rollers includes a heating roller having a heating portion therein, and a press roller provided in rolling contact with the heating roller and cooperating with the heating roller to heat and press the recording sheet passing between the heating roller and press roller.

4. A fixing device according to claim 1, wherein the pressure changing mechanism has a cam arranged in contact with a rotating shaft of the cleaning roller, and a driving source for rotating the cam.

5. A fixing device according to claim 1, wherein the pressure changing mechanism continuously changes the pressure between 400 g and 600 g.

6. A fixing device according to claim 3, wherein the cleaning mechanism includes a first cleaning roller provided in rolling contact with the heating roller to clean contamination on an outer surface of the heating roller, a first pressure changing mechanism for changing the pressure applied by the first cleaning roller to the heating roller at a period shorter than a passing time of the recording sheet passing between the heating roller and the press roller, a second cleaning roller provided in rotatable contact with the press roller to clean contamination on an outer surface of the press roller, and a second pressure changing mechanism for changing the pressure applied by the second cleaning roller to the press roller at a period shorter than a passing time of the recording sheet passing between the heating roller and the press roller.

7. A fixing device according to claim 6, wherein the first cleaning roller is formed of a felt roller, and the second cleaning roller is formed of a metal roller.

8. An image forming apparatus comprising:

an image forming section for forming a developer image on a recording sheet;

a fixing device for heating and pressing the recording sheet where the developer image has been formed by the image forming section, thereby fixing the developer image on the recording sheet;

a paper supply section for selectively supplying various types of recording sheets having different sizes; and a convey mechanism for conveying the recording sheet fed from the paper feed section through the image forming section and the fixing device, the fixing device including:

fixing means having a pair of rollers which are in rolling contact with each other, for fixing a developer image formed on a recording sheet passing between the pair of rollers;

a cleaning mechanism having a cleaning roller provided in rolling contact with at least one of the pair of rollers, for cleaning contamination on an outer surface of said one roller; and a pressure changing mechanism for changing a pressure applied by the cleaning roller to said one roller at a predetermined period in a fixing operation with respect to one recording sheet.

9. An image forming apparatus according to claim 8, wherein the predetermined period is shorter than a passing time of the recording sheet passing through the pair of rollers.

10. An image forming apparatus according to claim 9, wherein the pressure changing mechanism continuously changes the pressure between 400 g and 600 g.

11. An image forming apparatus according to claim 9, wherein the pair of rollers includes a heating roller having a heating portion therein, and a press roller provided in rolling contact with the heating roller and cooperating with the heating roller to heat and press the recording sheet passing between the heating roller and press rollers.

12. An image forming apparatus according to claim 8, wherein the pressure changing mechanism has a cam arranged in contact with a rotating shaft of the cleaning roller, and a driving source for rotating the cam.

13. An image forming apparatus according to claim 11, wherein the cleaning mechanism includes a first cleaning roller provided in rolling contact with the heating roller to clean contamination on an outer surface of the heating roller, a first pressure changing mechanism for changing the pressure applied by the first cleaning roller to the heating roller at a period shorter than a passing time of the recording sheet passing between the heating roller and the press roller, a second cleaning roller arranged in rolling contact with the press roller to clean contamination on an outer surface of the press roller, and a second pressure changing mechanism for changing the pressure applied by the second cleaning roller to the press roller at a period shorter than a passing time of the recording sheet passing between the heating roller and the press roller.

14. An image forming apparatus according to claim 13, wherein the first cleaning roller is formed of a felt roller, and the second cleaning roller is formed of a metal roller.

15. An image forming apparatus according to claim 8, wherein the pressure changing mechanism has a variable period shorter than a passing time with which a minimum-size recording sheet supplied from the paper supply section passes between the heating roller and the press roller.

16. A method of fixing a developer image formed on a recording sheet onto the recording sheet, the method comprising the steps of:

fixing a developer image formed on a recording sheet on the recording sheet by passing between a pair of rollers; and rotatably contacting a cleaning roller with at least one of the rollers and changing a pressure applied by the cleaning roller to said one roller at a predetermined period in a fixing operation with respect to one recording sheet, thereby cleaning contamination on an outer surface of said one roller.

17. A method according to claim 16, wherein the predetermined period is shorter than a passing time of the recording sheet passing through the pair of rollers.

18. A method according to claim 17, wherein the step of changing the pressure includes continuously changing the pressure between 400 g and 600 g.

* * * * *